US008562256B2

(12) United States Patent
Li et al.

(10) Patent No.: US 8,562,256 B2
(45) Date of Patent: Oct. 22, 2013

(54) FLOATING SYSTEM CONNECTED TO AN UNDERWATER LINE STRUCTURE AND METHODS OF USE

(75) Inventors: You Sun Li, Houston, TX (US); George Rodenbusch, Houston, TX (US); Heping Zhang, Cypress, TX (US); Jane Qing Zhang, Sugarland, TX (US)

(73) Assignee: Shell Oil Company, Houston, TX (US)

( * ) Notice: Subject to any disclaimer, the term of this patent is extended or adjusted under 35 U.S.C. 154(b) by 294 days.

(21) Appl. No.: 12/441,979

(22) PCT Filed: Sep. 19, 2007

(86) PCT No.: PCT/US2007/078876

§ 371 (c)(1), (2), (4) Date: May 20, 2009

(87) PCT Pub. No.: WO2008/036728

PCT Pub. Date: Mar. 27, 2008

(65) Prior Publication Data

US 2009/0269141 A1 Oct. 29, 2009

Related U.S. Application Data

(60) Provisional application No. 60/826,506, filed on Sep. 21, 2006.

(51) Int. Cl.
*E21B 17/01* (2006.01)

(52) U.S. Cl.
USPC ..... 405/224.2; 114/293

(58) Field of Classification Search
USPC ..... 405/224.3, 224.4, 224.2; 114/293; 441/3
See application file for complete search history.

(56) References Cited

U.S. PATENT DOCUMENTS

| | | | | |
|---|---|---|---|---|
| 4,065,822 | A * | 1/1978 | Wilbourn | 441/4 |
| 5,615,977 | A | 4/1997 | Moses et al. | 405/195.1 |
| 6,364,022 | B1 | 4/2002 | Kodaissi et al. | 166/367 |
| 2005/0063788 | A1 | 3/2005 | Clausen | 405/224.2 |
| 2007/0081862 | A1* | 4/2007 | Wolbers et al. | 405/169 |
| 2008/0089745 | A1* | 4/2008 | Salome et al. | 405/224.2 |
| 2009/0133612 | A1* | 5/2009 | Wajnikonis | 114/199 |

FOREIGN PATENT DOCUMENTS

| | | | |
|---|---|---|---|
| CN | 1118618 A | 3/1996 | E21B 43/01 |
| WO | WO9507405 | 3/1995 | E21B 43/01 |
| WO | WO2007017574 | 2/2007 | E21B 17/01 |

* cited by examiner

*Primary Examiner* — Sean Andrish

(57) ABSTRACT

There is disclosed a floating system positioned in a body of water having a water bottom, the system comprising a host member floating in the water; an elongated underwater line structure, comprising a top connected to the host; a bottom extending to the seabed and adapted to connect to a flowline lying on the seabed; a first portion of the line structure being shaped concave upward; a second portion of the line structure being shaped concave upward; and a transition segment between being shaped concave downward, the transition segment located between the first portion and the second portion.

9 Claims, 4 Drawing Sheets

FLOATING SYSTEM CONNECTED TO AN UNDERWATER LINE STRUCTURE AND METHODS OF USE

PRIORITY CLAIM

The present application claims priority of U.S. Provisional Application No. 60/826,506 filed 21 Sep. 2006.

FIELD OF THE INVENTION

The present invention relates to an underwater line structure, for example a riser, extending from a host at the seawater surface to the seabed, and to the process for making and using such systems.

DESCRIPTION OF THE RELATED ART

Several configurations for connecting floating structures with a seabed pipeline have been proposed. The configurations used depend, in general, on the parameters relating, in particular, to the depth of water and the horizontal and vertical movements of the floating structure being taken into consideration in order to select the appropriate configuration and/or the type of connection.

One frequently used configuration is known as the free-hanging configuration. In this configuration, the riser is freely hung on the host at its top, and forms a curved shape downwards, until it touches the seabed (touchdown point). After the touchdown point, the pipe horizontally lies on the seabed connecting to subsea facilities. In this configuration, and regardless of the type of riser used, the oscillations of the host may induce the oscillations of the bending curvatures of the pipe in the lower part of the riser, especially in the touch-down region. This host oscillation may lead to significant fatigue-damage in the vicinity of the touch-down point of the riser.

When a riser, in this free-hanging configuration, consists of a rigid tube, or of two concentric rigid tubes, it may be known as a steel catenary riser or SCR; the radius of curvature of the curved portion which must not cause stress exceeding the yield strength of the metallic material of which the SCR is made is relatively large, on the order of 100 meters or more.

A flexible pipe may be used in deep seas in the free-hanging configuration. It may have advantages over the SCR, for example, a smaller radius of curvature at the curved portion meeting the sea bed. Furthermore, it may allow greater vertical and horizontal movements of the host at the water surface due to improved fatigue behaviour. However, it may have the drawbacks of being very heavy, having worse thermal insulation compared to the SCR, and having a higher cost per unit length than the SCR.

A hybrid configuration may use a riser in which the lower part consists of a vertical rigid steel riser pipe and the upper part consists of a short flexible pipe (jumper). The weight of the riser may be taken up by buoyancy means at the top of the vertical rigid portion, and the host motions may be compensated for by the short length of flexible pipe.

U.S. Patent Application Publication Number 2005/0063788 discloses a hybrid riser having a lower section and an upper section, said upper section comprising a flexible pipe, and said lower section comprising a substantially rigid vertical pipe in communication with the flexible pipe, said riser further comprising a buoyancy section at or in the region of an upper end of said rigid pipe. Said buoyancy section also comprises an elongate cylindrical buoyancy element, which may be of a coaxial compartmentalized tubular construction having valves such that it may be controllably flooded or evacuated. The hybrid riser is directly anchored to the seabed foundation at its bottom. The hybrid riser may be constructed on land, and towed to the vicinity of the installation to which it is to be connected. U.S. Patent Application Publication Number 2005/0063788 is herein incorporated by reference in its entirety.

There is a need in the art for an SCR configuration that will not suffer early fatigue failure due to floating host motion action moving the touchdown point. There is a further need in the art for risers that are made of a single rigid material, that do not include flexible portions. There is a need in the art for low cost risers.

SUMMARY OF THE INVENTION

In one aspect, the invention provides a floating system positioned in a body of water having a water bottom, the system comprising a host member floating in the water; an elongated underwater line structure, comprising a top connected to the host; a bottom extending to the seabed and adapted to connect to a flowline lying on the seabed; a first portion of the line structure being shaped concave upward; a second portion of the line structure being shaped concave upward; and a transition segment between being shaped concave downward, the transition segment located between the first portion and the second portion.

In another aspect the invention provides a method of modifying a floating system, the system comprising a host floating in a body of water having a water bottom, an elongated underwater structure with a first end, a second end, and a body positioned between the first end and the second end, with the first end connected to the host, the body extending through the water, and the second end adjacent the water bottom, the method comprising lifting a transition segment of the body at a lift point, sufficient to form the transition segment of the body at a first water depth into a concave downward shape and a portion of the body at a second water depth into a concave upward shape, with the second water depth deeper than the first water depth. In some embodiments, the method also includes anchoring the transition segment of the body to the water bottom.

Advantages of the invention may include one or more of the following:

a SCR configuration that will not suffer early fatigue failure due to host action moving the touchdown point;

risers that are made of a single rigid material, or almost made of a single rigid material;

risers that have a majority of the portions made of a single rigid material;

Risers that may not include flexible portions; and low cost risers.

DETAILED DESCRIPTION OF THE INVENTION

Figure 1:
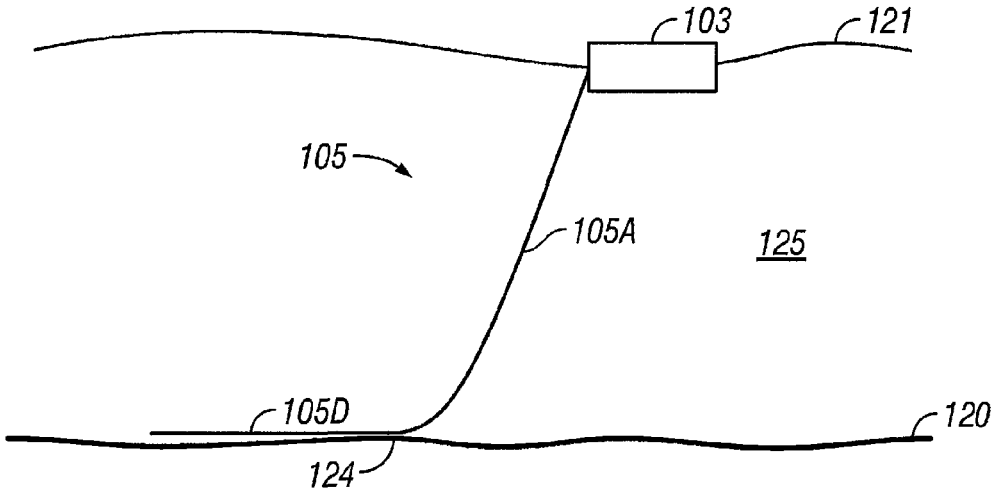
FIG. 1 (Prior Art)
FIG. 1 is a schematic representation of a prior art system comprising a floating host 103 at water surface 121 with tubular member 105 extending therefrom, with tubular member 105 having a riser portion 105A extending downwardly from floating host 103 through water 125 to touchdown point 124, and with member 105 having a pipeline portion 105D running along sea bed 120.

In one embodiment, there is disclosed a floating system positioned in a body of water having a water bottom, the system comprising a host member floating in the water; an elongated underwater line structure, comprising a top connected to the host; a bottom extending to the seabed and adapted to connect to a flowline lying on the seabed; a first portion of the line structure being shaped concave upward; a second portion of the line structure being shaped concave upward; and a transition segment between being shaped concave downward, the transition segment located between the first portion and the second portion. In some embodiments, the elongated underwater structure comprises a steel catenary riser. In some embodiments, the system also includes a buoyancy member connected to the transition segment. In some embodiments, the system also includes an anchor member connected to the transition segment. In some embodiments, the system also includes a buoyancy member connected to at least one of the transition segment, the first portion, and the second portion, by a plurality of connections. In some embodiments, the system also includes a plurality of buoyancy members connected to at least one of the transition segment, the first portion, and the second portion, by a plurality of connections. In some embodiments, the system also includes an anchor member connected to at least one of the transition segment, the first portion, and the second portion, by a plurality of connections. In some embodiments, the system also includes a plurality of anchor members connected to at least one of the transition segment, the first portion, and the second portion, by a plurality of connections. In some embodiments, the system also includes a buoyancy member mounted about the transition segment. In some embodiments, a lowest point of the first portion is from 5 to 50 meters lower than a highest point of the transition segment. In some embodiments, the transition segment comprises at least one of a pre-curved shore pipe, a bell-mouth, a bending restrictor, a tapered stress joint, a titanium stress joint, a flexible hose, and a deep-water flexible joint.

In one embodiment, there is disclosed a method of modifying a floating system, the system comprising a host floating in a body of water having a water bottom, an elongated underwater structure with a first end, a second end, and a body positioned between the first end and the second end, with the first end connected to the host, the body extending through the water, and the second end adjacent the water bottom, the method comprising lifting a transition segment of the body at a lift point, sufficient to form the transition segment of the body at a first water depth into a concave downward shape and a portion of the body at a second water depth into a concave upward shape, with the second water depth deeper than the first water depth. In some embodiments, the method also includes anchoring the transition segment of the body to the water bottom. In some embodiments, lifting the transition segment comprises lifting the transition segment from about 10 to 200 meters from the water bottom, for example from about 25 to about 100 meters, or about 50 meters. In some embodiments, the elongated underwater structure comprises a steel catenary riser. In some embodiments, the second water depth is from 5 to 50 meters deeper than the first water depth.

Before discussing the present invention, reference will be made to the prior art. Referring first to FIG. 1, there is shown a schematic representation of a prior art system with floating host 103 at water surface 121 with tubular member 105 extending therefrom. Tubular member 105 has riser portion 105A, which extends downwardly from floating host 103 through water 125 and intersecting seabed 120 at touchdown point 124. Tubular member 105 also has a pipeline portion 105D running along seabed 120.

As discussed in the Background section above, wave action acting upon floating host 103 translates energy through tubular member 105, which may cause fatigue damage to tubular member 105, for example near the touchdown point, which slides along the riser with the motion of the host.

One embodiment of the invention comprises one or more modifications to a conventional Steel Catenary riser. Between the riser top hanging on the host and the touchdown point at the seabed, one (or more locations) along the riser pipe may be lifted by a means of buoyancy member, such as air-can or buoyancy foam, and also anchored to the foundations on the seabed. The riser pipe between the top connected to the host and the lifted and anchored locations forms the first catenary configuration, normally, though not absolutely, with the vertex of the catenary configuration lower than the Buoyed and Anchored point. Below the Buoyed and Anchored point is the second catenary configuration, which touches the seabed. Beyond the touchdown point is the pipeline laying on the seabed. In the vicinity of the buoyed and anchored point, the pipe segment may be curved to form a transition between these two catenary configurations. To avoid an excessively small bending curvature and consequently a large bending stress level, the transitional pipe segment may be either constrained in its bending, such as by tapered stress joints or by bending restrictors, or may be made of a flexible component tolerating a small bending curvature.

In some embodiments, the riser bending moment is made controllable. For a conventional SCR, the host motion mainly induces the bending moment variation near the touch-down point. Since the touchdown point moves along the riser for a certain length by the host offset and water current, it is difficult to strengthen the riser along the length of a range of moveable touch-down points. In some embodiments, the touchdown point may be isolated from the host motions by being buoyed and anchored, and the main bending curvature and its variation may be concentrated to the Buoyed and Anchored location. Then it may be relatively easy to control the bending moment level at the point fixed along the riser. The reduction of the local bending moment near the Buoyed and Anchored point (the transitional segment) can be realized by two mechanisms. One is to limit the bending curvature by spreading the localized bending to a longer length, and the other is to use a flexible component to tolerate large local bending curvature.

In some embodiments, there is provided riser systems transporting liquid and/or gas from other facilities through a flowline lying on the seabed to a water surface floating production host, or from the host to export liquid and/or gas to other facilities through seabed flowlines. The riser top may be attached to the host, and at a point along the riser, the riser may be buoyed by a buoyancy member and anchored to a seabed foundation. The Buoyed and Anchored point divides the riser pipe into two sections, each with a different catenary configuration. In some embodiments, the riser is buoyed by a length of buoyancy modules along a short segment of the riser pipe and anchored at a point within the buoyed segment. In some embodiments, the buoyancy member lifts the riser pipe by a plurality of connectors and anchored by a plurality of anchor members. The plurality of buoyancy connectors and anchoring connectors help to form a smooth transition for these two catenary configurations. The numbers of the anchoring connectors and the numbers of the connectors for the buoyancy member may not necessarily be equal, and depend on the riser parameters. In some embodiments, the system includes a plurality of buoyancy members and plurality of anchoring connectors, which may allow the catenary transition to become further smoothed.

In some embodiments, the invention provides a method to reduce the level of the bending moment and its variations at the Buoyed and Anchored point. As a transition for two different catenary configurations, the transition segment may be subjected to significant bending. While isolated to the touchdown point, the oscillations of the host may be passed to the Buoyed and Anchored point. Besides a plurality of buoyancy and anchoring members, the pipe in the vicinity of the Buoyed and Anchoring points may also be designed to either restrict bending or tolerate the bending, by one or a combination of the following manners:

(1) Tapered stress joints near the Buoyed and Anchored points to reduce the bending stress level;
(2) A bell-mouth or other bending restrictor to restrict the bending curvature near the Buoyed and Anchored points within the desired upper limit;
(3) Titanium stress joints near the Buoyed and Anchored points, which have more flexibility for bending curvature than a steel pipe;
(4) A small piece of the jumper near the Buoyed and Anchored points to accept large bending curvature;
(5) A deep-water flexible joint at the Buoyed and Anchored points to tolerate bending; and/or
(6) Near the Buoyed and Anchored points, a small piece of the riser pipe may be pre-curved to form the mean bending curvature with little bending stress.

The details of the bending moment reduction method depend on the riser parameters and environmental conditions.

Figure 2:
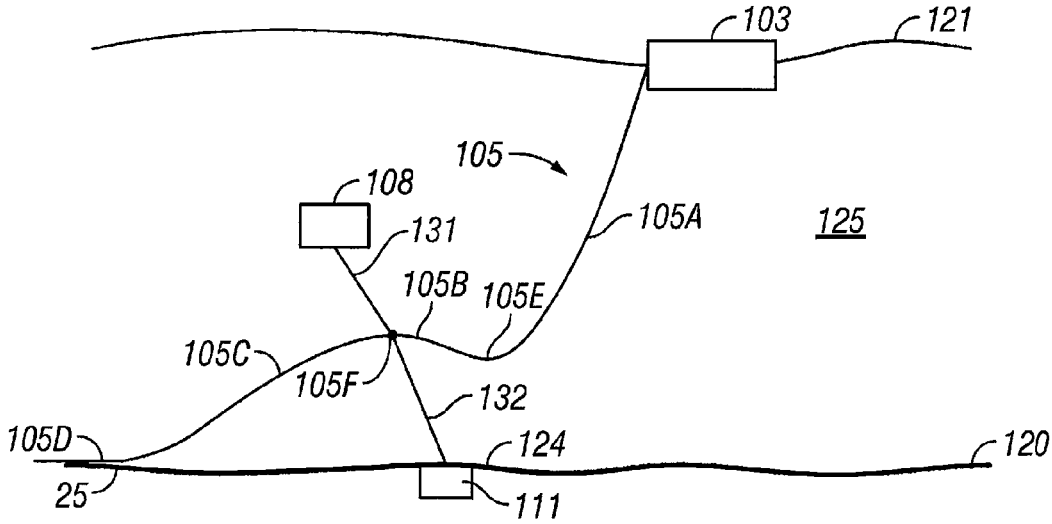
FIG. 2 is a schematic representation of one embodiment of the present invention in which is shown floating host 103 at water surface 121 with tubular member 105 extending therefrom and being lifted by buoyancy member 108 through connector 131 and anchored by connector 132 to foundation 111.

The present invention will now be further described by reference to the drawings. Referring now to FIG. 2, there is shown schematic representation of floating host 103 at water surface 121 with an underwater structure 105 extending therefrom.

It should be understood, that floating host 103 may be any type of floating structure having a line member extending toward the water bottom, which will be subjected to wave action through the response of floating host 103 to such wave action. For example, in the offshore hydrocarbon exploration, drilling, production, drilling, processing, or transportation art, non-limiting examples of floating hosts 103 include ships, boats, barges, rigs, platforms, FPSOs (Floating Production, Storage and Offloading systems), semisubmersibles, FSRUs (Floating, Storage and Regassification Units), and the like.

While shown floating at water surface 121, it should be understood that floating host 103 may also be floating below water surface 121, and could still be subjected to wave action, which usually extends the first few hundred feet below water surface 121. While shown floating apart from land, it should also be understood that floating host 103 may also be anchored to dry land, that is, either tethered to dry land, or partially supported by dry land (like a dock, wharf, or the like).

Elongated underwater line structure 105 may be any type of structure that extends from floating host 103 as are known in the offshore arts. Most commonly, underwater line structure 105 may be some sort of tubular member, generally referred to in the art as a "riser," non-limiting examples of which include umbilicals, tubes, ducts, pipes, conduits, but also may be a nontubular member such as cables, lines, tethers, and the like.

Underwater line structure 105 extends downwardly from floating host 103 through water 125 striking seabed 120 at new touchdown point 25, which is generally further away from host 103 than old touchdown point 124 (as seen in FIG. 1), and continuing along seabed 120. More specifically underwater structure 105 extends downwardly from floating host 103 through water 125 as a traditional riser portion 105A to a local low point/region 105E on structure 105, from where underwater structure 105 turns upwardly as riser portion 105B.

Buoyancy member 108 provides lift to underwater structure 105 at a lift point/region 105F, where the elevation of the point 105F may be restricted by the length of anchoring line 132 connected to the foundation 111. The buoyancy lowers down point/region 105E and lift point/region 105F at which the slope of underwater structure 105 is zero (0), with the slope of riser portion 105A and the slope of riser portion 105B having opposite signs or polarity, and the slope of riser portion 105B and 105C having opposite signs or polarity. The riser portion above the Buoyed and Anchoring point 105F and the riser portion below 105F are two different catenary configurations, and in the vicinity of 105F is a transition for these two catenary configurations.

Figure 3:
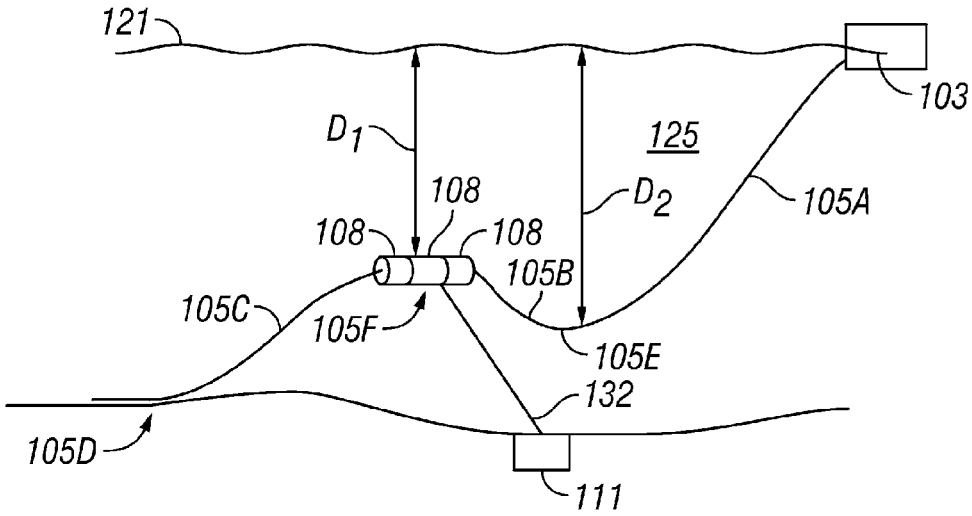
FIG. 3 is an illustration of another embodiment of the present invention, showing buoyancy member 108 affixed directly to underwater buoyancy structure 105, without the use of a connector member.

Referring now to FIG. 3, in some embodiments, buoyancy member 108 provides lift to underwater structure 105 at lift point/region 105F of water depth D1, and lifts it sufficient to form a local low point/region 105E at water depth D2 (where D2 may be deeper than D1) on structure 105. Which low point/region 105E is positioned on structure 105 between lift point/region 105F and floating host 103, and which low point/region 105E may be lower in water depth than lift point/region 105F.

It should be recognized from FIG. 2, that underwater structure 105 comprising riser portions 105A and 105B, is concave upward (away from seabed 120) with a low point at local low point/region 105E. Likewise, underwater structure 105 comprising riser portions 105C and 105D are also a catenary configuration concave upward at the touchdown point 105D. Then in the vicinity of 105B and 105C is concave downward (toward seabed 120) as a transition of these two catenary configurations.

Any of the numerous buoyant materials as are known in the marine art may be utilized, for example a foam or buoyancy can. Buoyancy member 108 may incorporate materials with densities suitable to provide buoyancy, or may incorporate voids or hollow members to provide buoyancy.

Buoyant member 108 may provide sufficient buoyancy to not only lift underwater structure 105 to a desired position above seabed 120, but also to support the weight of any materials traveling through underwater structure 105.

As shown in FIG. 2, buoyancy member 108 may be affixed to underwater structure 105 through the use of one or more connector members 131, which may be rigid or flexible as desired. Such connector members 131 may be cables, chains, rope, rods, and the like.

It should be understood that the manner of connecting buoyancy member 108 to underwater structure 105 is not critical, but rather a matter of design preference.

Referring again to FIG. 3, there is illustrated some embodiments showing buoyancy member 108 affixed directly to underwater structure 105, without the use of connector member 131 (as seen in FIG. 2). Buoyancy member 108 may be jacketed around structure 105, or may be made integral to structure 105.

Depending upon the physical properties of underwater structure 105 and other design parameters, it may be that providing lift at a lift point 105F as in FIG. 2 may cause too much stress for some types of structures and/or configurations. Alternatively, lift may be provided along a region to spread out the stress of lifting structure 105. For example, in some embodiments, as shown in FIG. 3, lift may be provided along a lift region 105F by use of a number of buoyancy members 108 (or one large elongated buoyancy member 108).

Figure 4:
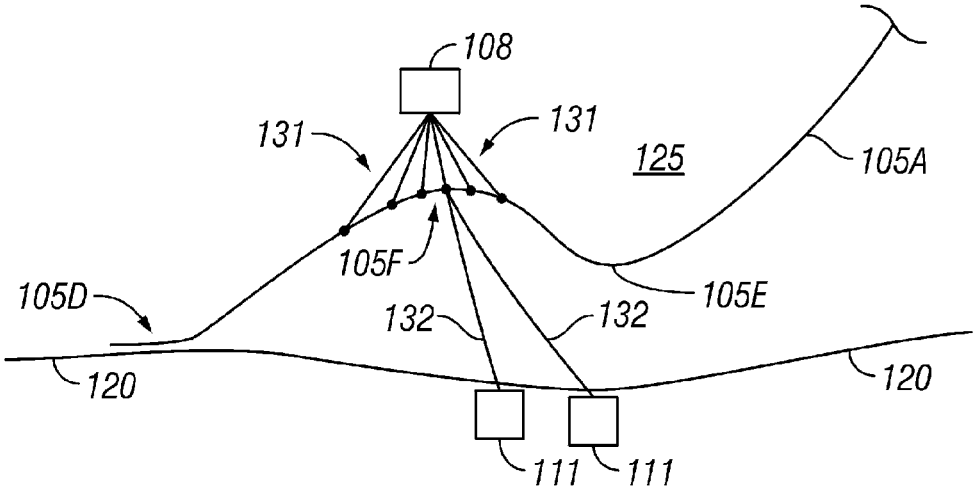
FIG. 4 is an illustration of another embodiment of the present invention, showing buoyancy member 108 connected to underwater structure at a plurality of points along lift zone 105F, and showing multiple anchors 111. The transition between two catenary configurations may become smooth.

In some embodiments, for creating a lift zone 105F, referring now to FIG. 4 there is shown buoyancy member 108 connected by a plurality of connectors 131 to underwater structure at a plurality of points along lift zone 105F.

Figure 5:
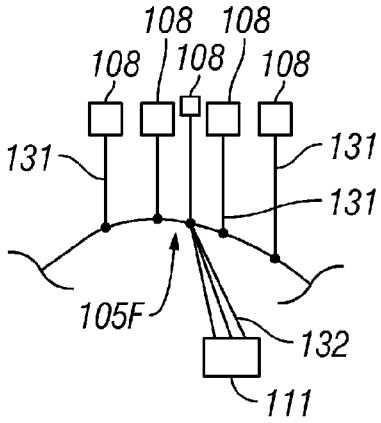
FIG. 5 is an illustration of another embodiment of the present invention, showing a plurality of buoyancy members 108 connected to a plurality of points along lift zone 105F.

In some embodiments, for creating a lift region 105F, referring now to FIG. 5 there is shown a plurality of buoyancy members 108 connected to a plurality of points along lift zone 105F.

Anchor 111 may be connected to underwater structure 105 through the use of connector 132, and is provided to stabilize position of underwater structure 105 against the buoyant lift of buoyancy member 108, and maintain it at a desired position.

Anchors are well known in the offshore and drilling arts, and any suitable anchors may be utilized as anchor 111. Anchor 111 may rest on water bottom 120, in which instance it will be of suitable weight to resist the lift of buoyancy member 108. Alternatively, anchor 111 may be affixed to water bottom 120.

As shown in FIGS. 2-5, anchor 111 may be affixed to underwater structure 105 through the use of connector members 132, which may be rigid or flexible as desired. Such connector members 132 may be cables, chains, rope, rods, and the like.

In some embodiments, redundancy in connecting structure 105 to anchor 111 may be provided by use of more than one connector member 132.

In some embodiments, a new riser member may be installed by extending it from host 103 to water bottom 120, and then lifting a portion of underwater structure 105 off of water bottom 120 to create the downwardly concave zone 105F and the upwardly concave zone 105E (as shown in FIG. 2).

In some embodiments, a new riser member may be installed by first, providing it with buoyancy member 108, and then extending it from host 103 to water bottom 120, and allowing it to form into an underwater structure 105 having a downwardly concave zone 105F and the upwardly concave zone 105E (as shown in FIG. 2).

In some embodiments, the segment of the riser pipe in the vicinity of the buoyed and anchored point 105F may be a piece of pre-curved pipe joint. With the pre-curved pipe joint, the transition between two different catenary configurations may not produce a large bending moment.

In some embodiments, the pipe segment buoyed and anchored point/region 105F is a number of tapered steel joints, which reduce the bending stress near 105F, in terms of the maximum stress and stress oscillations inducing fatigue, to acceptable levels.

In some embodiments, an external bell-mount or other forms of bending restrictors may be attached at segment buoyed and anchored point/region 105F. The pipe bending at this location may be restricted by the geometric configuration of the bell-mouth or other forms of bending restrictors.

In some embodiments, the pipe segment buoyed and anchored point/region 105F may be made of titanium, straight tube or tapered tubes. The low bending stiffness of titanium material allows a relatively large bending curvature at this region.

In some embodiments, short flexible hoses may be used in the region of the buoyed and anchored point 105F. With a flexible hose, a large bending curvature may be tolerated.

In some embodiments, a deep-water flexible joint may be used at the buoyed and anchored point 105F. The intersection of two catenary configurations above and below 105F may become an angle with a deep-water flexible joint.

While the present invention may be utilized for installing a new riser member, it may also find utility in a method of modifying an existing underwater structure 105. For example, for an existing floating host 103 having an underwater structure 105 extending to water bottom 120 (as shown in FIG. 1), a method of modifying would include lifting a portion of underwater structure 105 off of water bottom 120 to create the downwardly concave zone 105F and the upwardly concave zone 105E (as shown in FIG. 2).

EXAMPLES

Figure 6:
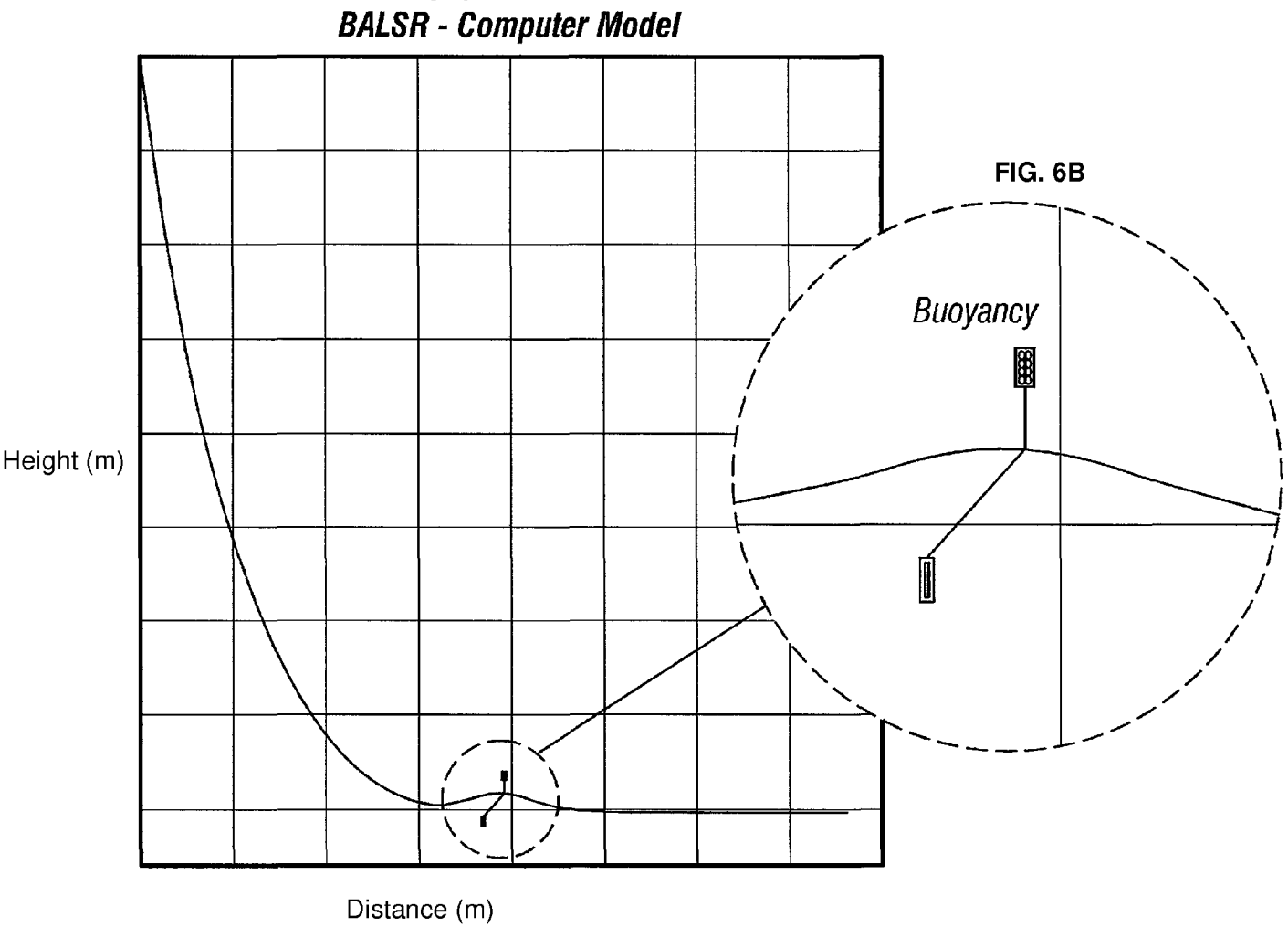
FIG. 6A is an illustration of a design, which was simulated in the examples.
FIG. 6B is an exploded view of a portion of the design.

A computer simulation of one embodiment of the present invention as shown in FIG. 6 was conducted.

Figure 7:
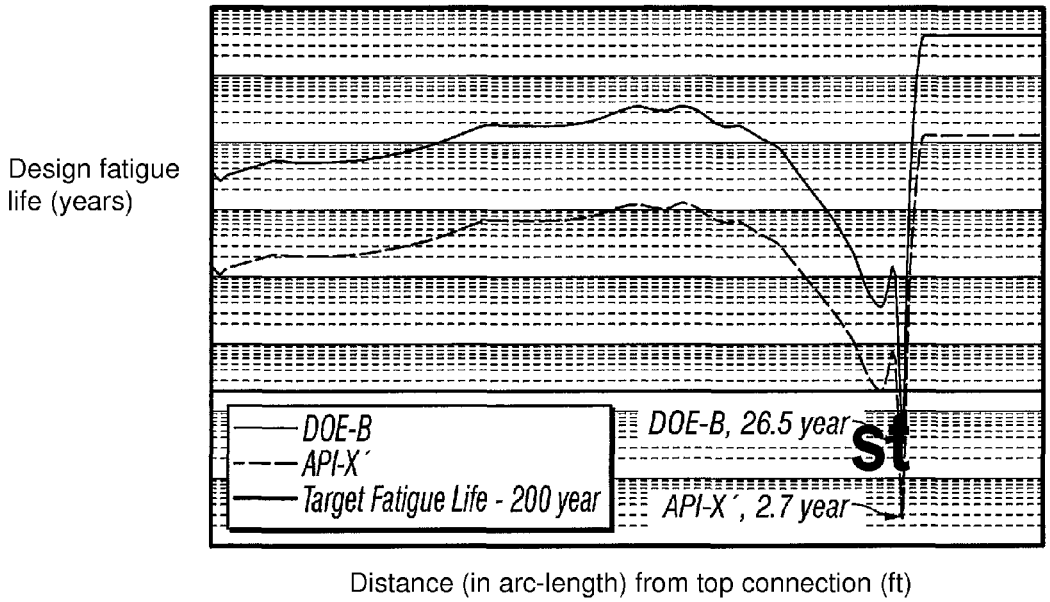
FIG. 7 shows simulated fatigue results for a prior art system as shown in FIG. 1, with results for "DOE-B" and "API-X" at 26.5 years and 2.7 years, respectively.

FIG. 7 shows the fatigue results for a prior art system as shown in FIG. 1, with results for "DOE-B" and "API-X" at 26.5 years and 2.7 years, respectively.

Figure 8:
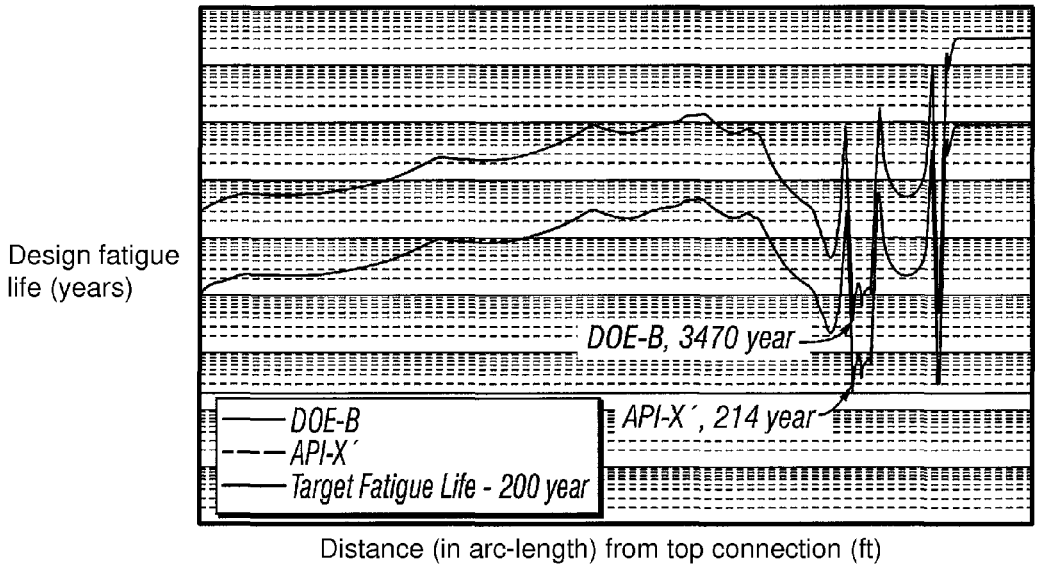
FIG. 8 shows simulated fatigue results for the system of FIG. 6, with results for "DOE-B" and "API-X" at 3470 years and 214 years, respectively.

FIG. 8 shows the fatigue results for the system of FIG. 6 which is one embodiment of the present invention, with results for "DOE-B" and "API-X" at 3470 years and 214 years, respectively. Fatigue life was increased 130 times, and 79 times, respectively, as compared to the prior art system as shown in FIG. 1.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

That which is claimed is:

1. A floating system positioned in a body of water above a seabed, the floating system comprising:

a host member floating in the body of water;

an elongated underwater line structure, comprising a steel catenary riser, which is substantially made of a single rigid material and does not include flexible portions and comprises:

a top connected to the host member;

a bottom extending to the seabed and adapted to connect to a flowline lying on the seabed;

a first portion shaped concave upward;

a second portion shaped concave upward; and a transition segment shaped concave downward, wherein the transition segment is located between the first portion and the second portion and wherein the transition segment comprises a buoyed and anchored point;

a buoyancy member connected to the buoyed and anchored point of the transition segment; and an anchor member connected to the buoyed and anchored point of the transition segment.

2. The floating system of claim 1, wherein the buoyancy member is directly connected to the transition segment without the use of a connector member.

3. The floating system of claim 1, wherein the anchor member is connected to the buoyed and anchored point of the transition segment through the use of a connector member.

4. The floating system of claim 1, further comprising additional buoyancy members connected to at least one of the transition segment, the first portion, and the second portion, by a plurality of connections.

5. The floating system of claim 1, further comprising additional anchor members connected to at least one of the transition segment, the first portion, and the second portion, by a plurality of connections.

6. The floating system of claim 1, wherein the buoyancy member is mounted about the transition segment.

7. The floating system of claim 1, wherein a lowest point of the first portion is from 5 to 50 meters lower than a highest point of the transition segment.

8. The floating system of claim 1, wherein the transition segment comprises at least one of a pre-curved shore pipe, a bell-mouth, a bending restrictor, a tapered stress joint, and a titanium stress joint.

9. The floating system of claim 1, wherein the steel catenary riser comprises a fixed bending point.

* * * * *